US007381034B2

(12) United States Patent
Shishido

(10) Patent No.: US 7,381,034 B2
(45) Date of Patent: Jun. 3, 2008

(54) HYDRODYNAMIC PRESSURE BEARING PUMP WITH A SHAFT AND A BEARING HAVING HYDRODYNAMIC PRESSURE GENERATING GROOVES

(75) Inventor: Yuji Shishido, Kanagawa (JP)

(73) Assignee: Sony Corporation (JP)

( * ) Notice: Subject to any disclaimer, the term of this patent is extended or adjusted under 35 U.S.C. 154(b) by 387 days.

(21) Appl. No.: 10/505,090

(22) PCT Filed: Dec. 24, 2003

(86) PCT No.: PCT/JP03/16618

§ 371 (c)(1),
(2), (4) Date: Aug. 19, 2004

(87) PCT Pub. No.: WO2004/059171

PCT Pub. Date: Jul. 15, 2004

(65) Prior Publication Data

US 2005/0152782 A1 Jul. 14, 2005

(30) Foreign Application Priority Data

Dec. 26, 2002 (JP) ..... 2002-378096

(51) Int. Cl.
*F04B 17/04* (2006.01)

(52) U.S. Cl. ..... 417/423.12

(58) Field of Classification Search ..... 417/423.12, 417/416, 417, 545; 415/111, 112, 229, 170.1
See application file for complete search history.

(56) References Cited

U.S. PATENT DOCUMENTS 4,470,752 A * 9/1984 Teruo et al. ..... 415/72
4,846,152 A * 7/1989 Wampler et al. ..... 600/16
5,120,139 A * 6/1992 Asada et al. ..... 384/107

(Continued)

FOREIGN PATENT DOCUMENTS

CA 2 251 322 A1 2/2003

(Continued)

OTHER PUBLICATIONS

International Search Report dated Feb. 17, 2004.

(Continued)

*Primary Examiner*—Devon Kramer
*Assistant Examiner*—Vikansha Dwivedi
(74) *Attorney, Agent, or Firm*—Rader Fishman & Grauer PLLC; Ronald P. Kananen

(57) ABSTRACT

A hydrodynamic pressure bearing type pump includes a main body having a fluid flow inlet formed at one end portion thereof and a fluid flow outlet formed at the other end portion thereof and a rotating portion disposed within a fluid flow passage of the fluid within the main body to generate hydrodynamic pressure to let the fluid flow into the fluid flow inlet and to let the fluid flow from the fluid flow outlet to the outside. The rotating portion includes a shaft, a hydrodynamic pressure bearing for generating hydrodynamic pressure to let the fluid flow into the fluid flow inlet and to let the fluid flow from the fluid flow outlet to the outside when the shaft is rotated and a rotation force generating portion disposed within the main body to generate rotation force for rotating the shaft when it is energized.

14 Claims, 5 Drawing Sheets

U.S. PATENT DOCUMENTS 5,928,131 A 7/1999 Prem

FOREIGN PATENT DOCUMENTS

| | | | |
|---|---|---|---|
| CA | 2 405 292 | A1 | 10/2003 |
| DE | 198 54 724 | A1 | 5/1999 |
| DE | 100 05 432 | A1 | 8/2000 |
| FR | 2 771 295 | A1 | 5/1999 |
| FR | 2 789 316 | A1 | 8/2000 |
| FR | 2 802 428 | A1 | 6/2001 |
| FR | 2 802 429 | A1 | 6/2001 |
| GB | 2 335 146 | A | 9/1999 |
| GB | 2 340 404 | A | 2/2000 |
| GB | 2 340 405 | A | 2/2000 |
| GB | 2 347 085 | A | 8/2000 |
| GB | 2 365 346 | A | 2/2002 |
| GB | 2 365 347 | A | 2/2002 |
| GB | 2 365 348 | A | 2/2002 |
| JP | 56-162294 | | 12/1981 |
| JP | 56-162294 | A | 12/1981 |
| JP | 02-081997 | | 3/1990 |
| JP | 2-81997 | A | 3/1990 |
| JP | 03-020112 | | 1/1991 |
| JP | 3-20112 | A | 1/1991 |
| JP | 06-102087 | | 12/1994 |
| JP | 11-241695 | | 9/1999 |
| JP | 11-241695 | A | 9/1999 |
| JP | 1010651 | A1 | 6/2000 |
| JP | 2000-229125 | A | 8/2000 |

OTHER PUBLICATIONS

Japanese Office Action; Application No. 2002-378096; dated Jan. 30, 2007.

* cited by examiner

First Hydrodynamic Pressure P15<
Second Hydrodynamic Pressure P16

Flow Inlet Angle θ15 >Flow Inlet Angle θ16

Width L15 <Width L16

Prior Art

HYDRODYNAMIC PRESSURE BEARING PUMP WITH A SHAFT AND A BEARING HAVING HYDRODYNAMIC PRESSURE GENERATING GROOVES

TECHNICAL FIELD

The present invention relates to a hydrodynamic pressure bearing type pump suitable for the application to a power source for letting fluid flow.

BACKGROUND ART

A pump for letting fluid flow is applied to an artificial heart, for example (see Japanese published patent application No. Hei 6-102087 (pp. 3 to 5 and FIG. 5), for example).

DISCLOSURE OF THE INVENTION

The above-mentioned conventional pump is shown in FIG. 6, and FIG. 7 shows a hydrodynamic pressure bearing of the conventional pump shown in FIG. 6.

Referring to FIG. 6, a conventional pump 310 includes a hydrodynamic pressure shaft 320 with hydrodynamic pressure generating grooves of radial and thrust directions and a rotor magnet 322. The hydrodynamic pressure shaft 320 and the rotor magnet 322 rotate in unison with each other, and further an armature coil 323 for energizing the rotor magnet 322 also is disposed within a pump diaphragm 324.

In the conventional pump 310, the hydrodynamic pressure bearing 321 functions as a pressure generating means for pumping fluid, and it functions as a means for rotatably supporting the rotor magnet 322 in the radial and thrust directions as well.

Also, since the armature coil 323 and the rotor magnet 322 are disposed within the pump diaphragm 324, it seems that this conventional pump is free from leakage of fluid and hence it seems that this conventional pump is a reliable pump.

The conventional pump 310, however, encounters with the following drawbacks.

The hydrodynamic pressure bearing 321 mounted on the conventional pump is combined with the rotor magnet 322 and it is rotatably supported by a sleeve 331. As shown in FIG. 7, the hydrodynamic pressure bearing 321 comprises one hydrodynamic pressure generating groove 332 for supporting the radial direction and another hydrodynamic pressure generating groove 333 for supporting the thrust direction and hence holds both of the radial and thrust directions.

Since the rotor magnet 322 is supported by the hydrodynamic pressure bearing 333 of the thrust direction, there is a defect that the rotor magnet cannot be reduced in diameter without difficulty.

In order that the hydrodynamic pressure bearing 321 may rotate to generate hydrodynamic pressures to let fluid flow to the outside of the pump as shown by an arrow A in FIG. 7, a hydrodynamic pressure Pd333 from the hydrodynamic pressure generating groove 333 of the thrust direction on the fluid entrance side should constantly be smaller than a hydrodynamic pressure Pd332 from the hydrodynamic pressure generating means 332 of the radial direction on the fluid exit side.

For example, once the hydrodynamic pressure bearing shaft 321 generates the same hydrodynamic pressure, the hydrodynamic pressure bearing shaft only pulls fluid into the inside of the hydrodynamic pressure bearing shaft 321 and is unable to move the fluid. Conversely, if the hydrodynamic pressure Pd332 on the fluid exit side becomes smaller, then the fluid will flow to the opposite direction.

However, the conventional pump 310 has not yet created the rules to determine a relationship between the magnitudes of generated hydrodynamic pressures, and also it has not yet devised any method for adjusting hydrodynamic pressures.

If it happens that the hydrodynamic pressure Pd333 on the side of the hydrodynamic pressure generating groove 333 of the fluid entrance side is set to be small so that the fluid may flow to the fluid exit side, that is, in the direction shown by the arrow A, then the sleeve 331 moves from the low hydrodynamic pressure side to the high hydrodynamic pressure side. There is then a defect that it is difficult to support the hydrodynamic pressure bearing 321 at the constant position.

More specifically, in order to use this conventional hydrodynamic pressure bearing type pump actually, such conventional pump needs something for fixing the hydrodynamic pressure bearing 321 to the axial direction, such as to dispose a pivot bearing or to dispose another hydrodynamic pressure generating means on the rear of the hydrodynamic pressure generating groove 333. However, it is impossible to dispose these means on the conventional pump.

As described above, there is a drawback that the hydrodynamic pressure bearing provided within the conventional hydrodynamic pressure bearing type pump is not suitable for use in actual practice.

Also, while the conventional hydrodynamic pressure bearing type pump is characterized in that the rotor magnet 333 and the armature coil 323 are both disposed in the inside of the pump, it is natural that the armature coil 323, which is frequently made of a silicon steel or the like, should be energized with application of an electric current. Therefore, this armature coil tends to gather rust and it is not suitable for locating such armature coil in the liquid.

In addition, the rotor magnet 322 also is frequently made of a metal and there is a large possibility that the rotor magnet will rust. Hence, it is not suitable that such rotor magnet is disposed in the liquid.

Further, according to the conventional hydrodynamic pressure bearing type pump, the outer wall of the pump is composed of a combination of a plurality of members such as the cylindrical portion 325 and the diaphragm 324 in order to dispose the motor within the pump. However, it is difficult to perfectly tightly-close the portion in which the cylindrical portion 325 and the diaphragm 324 are fastened together in order to prevent liquid from being leaked from the pump. Hence, the conventional pump becomes unreliable.

Therefore, it is an object of the present invention to provide a hydrodynamic pressure bearing type pump in which the above-described problems can be solved, in which a shaft rotates to generate hydrodynamic pressures to freely rotate the shaft in the radial direction, in which a hydrodynamic pressure bearing can reliably generate fluid pumping pressures and which can be miniaturized.

According to the present invention, there is provided a hydrodynamic pressure bearing type pump in which a shaft rotates to generate hydrodynamic pressure to let fluid flow. The hydrodynamic pressure bearing type pump includes a main body having a fluid flow inlet formed at one end portion and a flow outlet of the fluid formed at the other end portion and a rotation portion located within a fluid passage of the fluid within the main body and which generates hydrodynamic pressure to let the fluid flow from the fluid flow inlet to the fluid flow outlet. The rotation portion includes a shaft, a hydrodynamic pressure bearing for generating hydrodynamic pressure to let the fluid flow from the fluid flow inlet to the fluid flow outlet and a rotation force generating portion disposed within the main body and which rotates the shaft when it is energized. The above-described hydrodynamic pressure bearing includes a first hydrodynamic pressure generating groove formed at the position near the fluid flow inlet and a second hydrodynamic pressure generating groove formed at the position near the fluid flow outlet. The hydrodynamic pressure bearing type pump is characterized in that hydrodynamic pressure generated from the first hydrodynamic pressure generating groove with respect to the radial direction when the shaft rotates is smaller than second hydrodynamic pressure generated from the second hydrodynamic pressure generating groove with respect to the radial direction.

In the present invention, the main body includes the fluid flow inlet formed at one end portion thereof. The main body includes the fluid flow outlet formed at the other end portion thereof.

The rotating portion is disposed within the fluid passage to let fluid to flow within the main body. The rotating portion generates hydrodynamic pressure to let fluid flow from the fluid flow inlet and to let fluid flow to the outside from the fluid flow outlet.

The hydrodynamic pressure bearing of the rotating portion generates hydrodynamic pressure to let fluid flow into the fluid flow inlet and to let fluid flow from the fluid flow outlet to the outside when the shaft of the rotating portion rotates. The rotation force generating unit is a driving unit located within the main body and which rotates the shaft when it is energized.

The hydrodynamic pressure bearing includes the first and second hydrodynamic pressure generating grooves. The first hydrodynamic pressure generating groove is formed at the position near the side of the fluid flow inlet. The second hydrodynamic pressure generating groove is formed at the position near the side of the fluid flow outlet.

First hydrodynamic pressure that the first hydrodynamic pressure generating groove generates with respect to the radial direction is smaller than second hydrodynamic pressure that the second hydrodynamic pressure generating groove generates with respect to the radial direction.

Thus, the hydrodynamic pressure bearing plays the role of rotatably supporting the shaft in the radial direction and it plays the role of generating fluid pumping pressure as well. More specifically, since the first hydrodynamic pressure is smaller than the second hydrodynamic pressure, the hydrodynamic pressure bearing is able to reliably generate pumping pressure to let fluid move from the fluid flow inlet through the fluid flow outlet to one direction so that fluid can flow reliably.

Since the hydrodynamic pressure bearing plays the role of rotatably supporting the shaft in the radial direction and it plays the role of generating fluid pumping pressure as well, the hydrodynamic pressure bearing type pump can be miniaturized.

Also, according to the present invention, in the above-mentioned hydrodynamic pressure bearing type pump, an end portion of the above-described shaft is supported to the thrust bearing located within the main body so as to become rotatable in the thrust direction.

In the present invention, the end portion of the shaft is supported to the thrust bearing located within the main body so that it can rotate in the thrust direction.

As a result, the shaft is able to reliably rotate with respect to its axial direction.

Also, according to the present invention, in the above-mentioned hydrodynamic pressure bearing type pump, a width of the above-described first hydrodynamic pressure generating groove with respect to the axial direction of the shaft is small as compared with a width of the above-described second hydrodynamic pressure generating groove with respect to the axial direction of the shaft.

In the present invention, the width of the first hydrodynamic pressure generating groove with respect to the axial direction of the shaft is set to be small as compared with the width of the second hydrodynamic pressure generating groove with respect to the axial direction of the shaft.

According to this arrangement, the first hydrodynamic pressure can be made smaller than the second hydrodynamic pressure.

In addition, according to the present invention, in the above-mentioned hydrodynamic pressure bearing type pump, a diameter of the above-described shaft is smaller at its portion near the fluid flow inlet than a diameter of the above-described shaft at its portion near the fluid flow outlet.

In the present invention, the diameter of the shaft is set to be smaller at its portion near the fluid flow inlet than the diameter of the shaft at its portion near the fluid flow outlet.

Consequently, the first hydrodynamic pressure can be made further smaller than the second hydrodynamic pressure.

Also, according to the present invention, in the above-mentioned hydrodynamic pressure bearing type pump, a groove depth of the above-described first hydrodynamic pressure generating groove is smaller than a groove depth of the above-described second hydrodynamic pressure generating groove.

In the present invention, the groove depth of the first hydrodynamic pressure generating groove is smaller than that of the second hydrodynamic pressure generating groove.

In consequence, the first hydrodynamic pressure can be made further smaller than the second hydrodynamic pressure.

Also, according to the present invention, in the above-mentioned hydrodynamic pressure bearing type pump, the first and second hydrodynamic pressure generating grooves are herring-bone grooves, and a fluid inlet angle of the above-described first hydrodynamic pressure generating groove is large as compared with a fluid inlet angle of the second hydrodynamic pressure generating groove.

In the present invention, the first and second hydrodynamic pressure generating grooves are both the herring-bone grooves. The fluid inlet angle of the first hydrodynamic pressure generating groove is large as compared with that of the second hydrodynamic pressure generating grove.

Consequently, the first hydrodynamic pressure can be made further smaller as compared with the second hydrodynamic pressure.

Also, according to the present invention, in the above-described hydrodynamic pressure bearing type pump, the main body has the diaphragm located therein, the above-described rotation force generating portion includes the armature coil and a magnet to rotate the shaft when the above-described armature coil is energized, the above-described armature coil is located at the outside of the above-described diaphragm within the main body, and the above-described magnet is fixed to the outer peripheral surface of the shaft.

In the present invention, the magnet in the rotation force generating portion is able to rotate the shaft owing to magnetic interaction produced when the armature coil of the rotation force generating portion is energized. The armature coil is located at the outside of the diaphragm within the main body. The magnet is fixed to the outer peripheral surface of the shaft.

In consequence, the armature coil is isolated from fluid by the diaphragm, and hence the armature coil can be prevented from being exposed to the fluid.

Also, according to the present invention, in the above-mentioned hydrodynamic pressure bearing type pump, the magnet has a coating member disposed on its surface to cover the magnet from the fluid.

In the present invention, the magnet has the coating member disposed on its surface to cover the magnet from the fluid. Thus, the magnet can be protected from the fluid.

Also, according to the present invention, in the above-mentioned hydrodynamic pressure bearing type pump, the above-described main body is another diaphragm for covering the circumference of the diaphragm.

In the present invention, the main body is composed of another diaphragm for covering the circumference to the diaphragm.

In addition, according to the present invention, in the above-mentioned hydrodynamic pressure bearing type pump, a cylindrical member of the above-described hydrodynamic pressure bearing is made of a sintered metal and the above-described fluid is lubricating oil.

In the present invention, the cylindrical member of the hydrodynamic pressure bearing is made of the sintered metal and the fluid is the lubricating oil.

BEST MODE FOR CARRYING OUT THE INVENTION

An embodiment according to the present invention will be described below with reference to the accompanying drawings in detail.

Although various preferable limits are imposed upon the following embodiment from a technology standpoint because the following embodiment is a preferred embodiment of the present invention, the scope of the present invention is not limited to the embodiment so long as the present invention is not particularly limited by the descriptions, which limit the present invention, in the following description.

Figure 1:
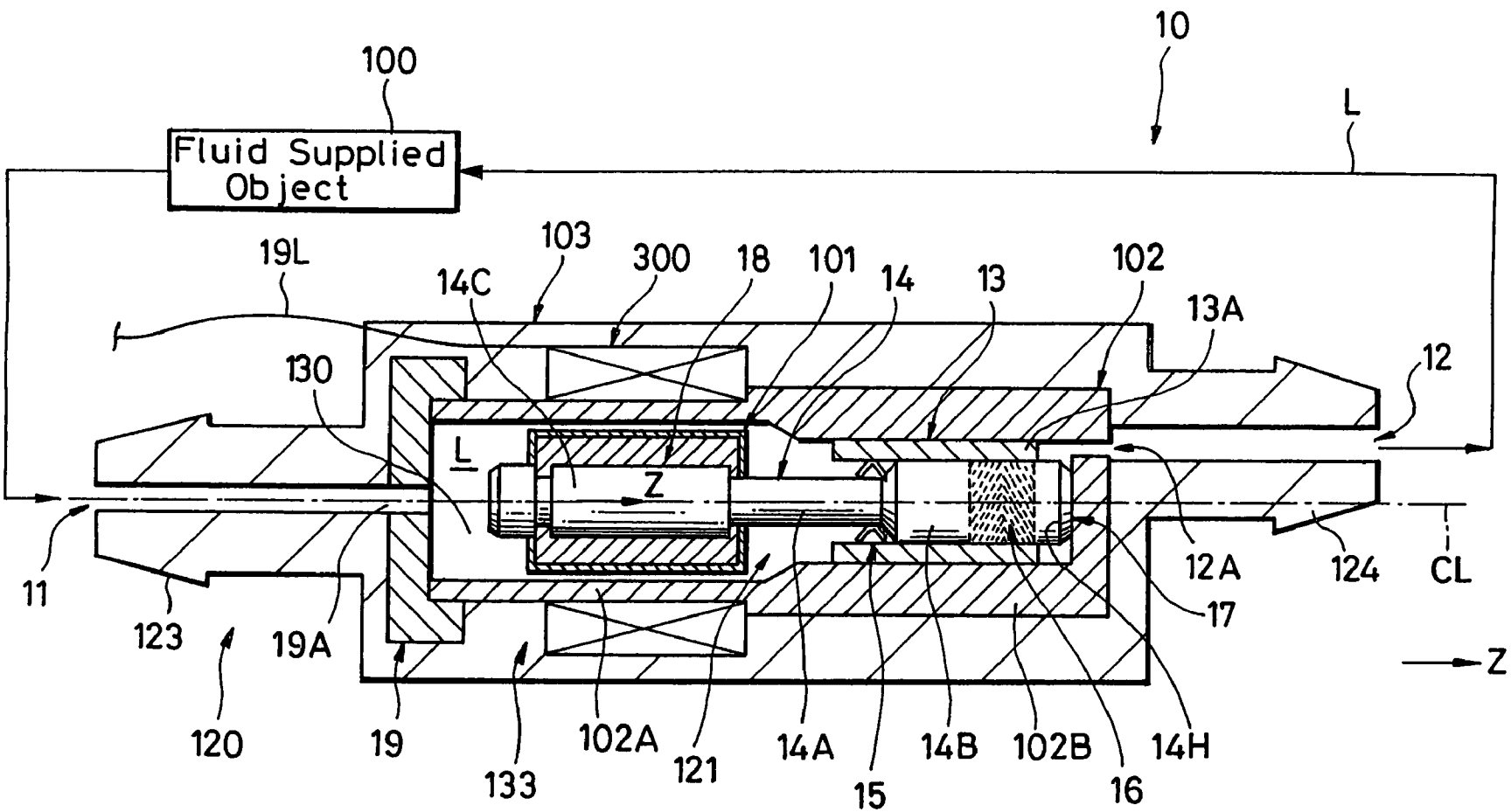
FIG. 1 is a cross-sectional view showing a hydrodynamic pressure generating bearing type pump according to a preferred embodiment of the present invention.

FIG. 1 shows a hydrodynamic pressure bearing type pump (hereinafter referred to as a "pump") according to a preferred embodiment of the present invention.

A pump 10 is a pump to supply fluid L to a fluid supplied object 100.

This pump 10 serves as a means for supporting rotation of a shaft 14 and serves as a pressure generating means for generating pumping pressure to the fluid L as well.

The pump 10 is provided with a main body 120 and a rotating portion 121.

The main body 120 includes a first diaphragm 102, a space forming member 19 and an outermost wall 103. The outermost wall 103 is a second diaphragm. The outermost wall 103 accommodates therein the first diaphragm 102 and the space forming member 19.

A fluid flow inlet 11 is bored on one end portion 123 of the outermost wall 103 of the main body 120. A fluid flow outlet 12 is bored at the other end portion 124 of the outermost wall 103. Axial directions of the fluid flow inlet 11 and the fluid flow outlet 12 are slightly deviated from each other. Although the fluid flow inlet 11 is extended through the central portion of the axial direction of the main body 120, the fluid flow outlet 12 is located at the position slightly displaced from the central portion of the main body.

The first diaphragm 102 is a substantially cylindrical member, for example. The first diaphragm 102 includes a thrust bearing 17. The first diaphragm 102 includes a through-hole 12A which communicates with the fluid flow outlet 12.

The first diaphragm 102 is slightly smaller in outer diameter at its portion 102A on the side of the fluid flow inlet 11 as compared with an outer diameter at its portion 102B on the side of the fluid flow outlet 12 of the first diaphragm 102. The first diaphragm 102 forms a fluid flow passage 130 extended within the pump 10. This fluid flow passage 130 is communicated with the fluid flow inlet 11 of the fluid and the fluid flow outlet 12 of the fluid.

The first diaphragm 102 can be made of a metal such as a brass and a stainless steel or it can be made of a high polymer material such as LCP (liquid-crystal polymer), PPS (polyphenylene sulfide) polyamide, polyimide, PC (polycarbonate) and POM (polyacetal).

The space forming member 19 is an annular member provided on the side of the fluid flow inlet 11 of the fluid. The space forming member 19 has at its center bored a through-hole 19A to join the fluid flow inlet 11 of the fluid and the fluid flow passage 130. The space forming member 19 is adapted to reliably prevent fluid from being leaked from the pump and joins the outermost wall 130 and the end portion of the portion 102A.

Next, the structure of the rotating portion 121 will be described.

The rotating portion 121 is located in the form in which it is sealed into the main body 120.

The rotating portion 121 includes a shaft 14, a hydrodynamic pressure bearing 13 and a rotation force generating portion 133.

The shaft 14 is made of a metal such as a stainless steel or it is made of the above-mentioned high polymer material such as LCP, PPS, polyamide, polyimide and PC. The shaft 14 has a hemispherical surface end portion 14H formed at an end thereof. This end portion 14H is supported to a thrust bearing 17 such that it can rotate in the thrust direction. This end portion 14H is located at the side of the fluid flow inlet 12.

The shaft 14 includes a first portion 14A, a second portion 14B and a third portion 14C.

The first portion 14A is formed between the third portion 14C and the second portion 14B. A diameter of the first portion 14A is smaller than those of the second portion 14B and the third portion 14C. More specifically, the first portion 14A is set to be small in diameter at its position near the side of the fluid flow inlet 11 as compared with a diameter of the second portion 14B at its position near the side of the fluid flow outlet 12.

The hydrodynamic pressure bearing 13 shown in FIG. 1 includes a cylindrical member 13A.

The cylindrical member 13A is fixed to the inner peripheral surface of the first diaphragm 102 with pressure. The cylindrical member 13A is a member made of a metal such as a brass and a stainless steel or a high polymer material such as LCP, PPS, polyamide, polyimide and PC. This cylindrical member 13A may preferably be made of, in particular, a sintered metal, and fluid should be lubricating oil or water, for example.

Figure 2:
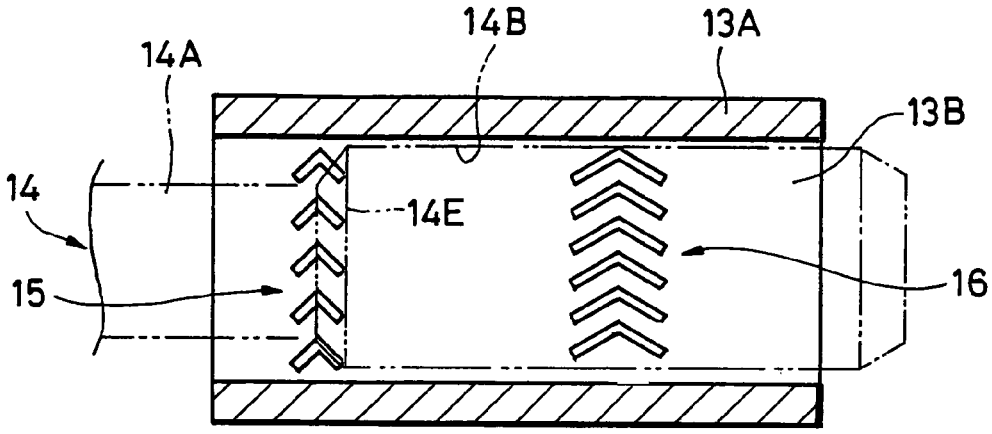
FIG. 2 is a diagram showing part of a bearing portion of the pump shown in FIG. 1 in an enlarged-scale.
Figure 3A:
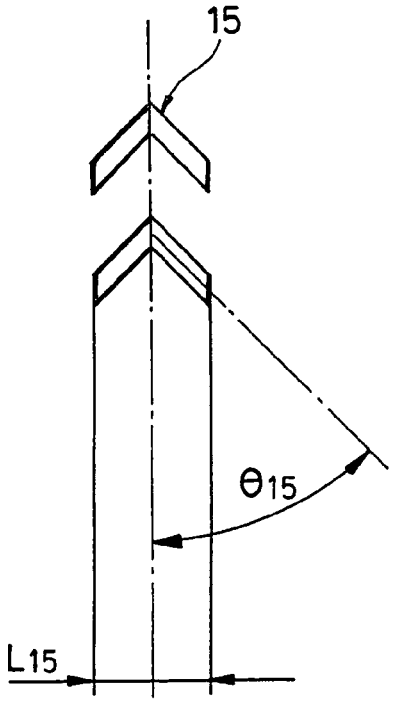
FIG. 3, consisting of FIG. 3A and FIG. 3B, are diagrams showing examples of shapes of first and second hydrodynamic pressure generating grooves of the shaft shown in FIG. 2.
Figure 3B:
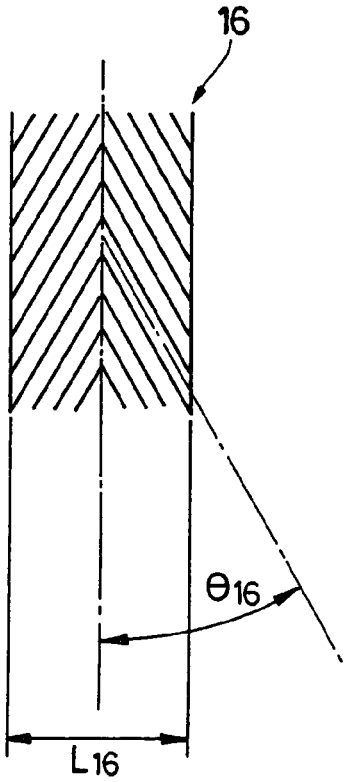

FIG. 2 and FIGS. 3A and 3B show the shapes of the first and second hydrodynamic pressure generating grooves 15 and 16.

The first and second hydrodynamic pressure generating grooves 15 and 16 are formed on the inner peripheral surface 13B of the cylindrical member 13A along the circumference direction.

FIG. 2 shows the state in which the first and second hydrodynamic pressure generating grooves 15 and 16 are formed on the inner peripheral surface 13B of the cylindrical member 13A with an interval.

As shown in FIG. 2, the outer peripheral surface of the second portion 14B of the shaft 14 is faced to the second hydrodynamic pressure generating groove 16. A stepped portion 14E is provided between the second portion 14B and the first portion 14A of the shaft 14, and this stepped portion 14E is faced to the first hydrodynamic pressure generating groove 15.

It is preferable that the first hydrodynamic pressure generating groove 15 shown in FIGS. 2 and 3A and the second hydrodynamic pressure generating groove 16 shown in FIGS. 2 and 3B are both of herring-bone grooves.

As shown in FIG. 3, a fluid inlet angle θ15 of the first hydrodynamic pressure generating groove 15 is set to be large as compared with a fluid inlet angle θ16 of the second hydrodynamic pressure generating groove 16. In addition, it is preferable that a width L15 of the axial direction of the first hydrodynamic pressure generating groove 15 is set to be small as compared with a width L16 of the axial direction of the second hydrodynamic pressure generating groove 16.

Next, the rotation force generating portion 133 shown in FIG. 1 will be described.

The rotation force generating portion 133 includes a coil 300 and a rotor magnet 18. The rotor magnet 18 is fixed to the outer peripheral surface of the third portion 14C of the shaft 14.

The rotor magnet 18 has a coating member 101 formed on its outer peripheral surface to isolate it from fluid. This coating member 101 may be provided by coating a high polymer material such as LCP, polyamide and polyimide or it may be provided by an outsert molding.

Even when the rotor magnet 18 is made, for example, of a sintered metal such as Nd—Fe—B, Sm—Co, or ferrite and hence it is easily rusted by fluid, since this coating member 101 is formed on the surface of the rotor magnet 18, if fluid is water, for example, then the rotor magnet 18 can be prevented from being exposed to the water. As a result, the rotor magnet 18 can be prevented from being rusted.

A coil 300 is fixed to the outside of the portion 102A of the first diaphragm 102. This coil 300 is sealed into the outermost wall 103. A lead wire 19L of the coil 300 is led out to the outside through the outermost wall 103. Since the coil 300 is located between the first diaphragm 102 and the outermost wall 103 as described above, the coil 300 can be protected from being exposed to the fluid. Accordingly, the coil 300 can be prevented from rusting and hence it is highly reliable.

The rotor magnet 18 is a magnet in which a number of S poles and N poles are magnetized in the circumference direction. When this coil 300 is energized with a predetermined energizing pattern from the outside, the shaft 14 can continue to rotate about the central axis CL within the fluid flow passage 130 by interaction of a magnetic field generated from the rotor magnet 18 and a magnetic field generated from the coil 300. This central axis CL is extended along the direction Z in which the fluid is to be pumped.

Next, the hydrodynamic pressure bearing 13 shown in FIG. 1 will be described more in detail.

As the shaft 14 is rotated, the hydrodynamic pressure bearing 13 generates pumping pressure to let the fluid L flow into the fluid flow inlet 11 and to let the fluid flow from the fluid flow outlet 12.

This hydrodynamic pressure bearing 13 acts to pump the fluid from the fluid flow inlet 11 to the side of the fluid flow outlet 12. In addition, this hydrodynamic pressure bearing 13 functions to rotatably support the shaft 14 with respect to the radial direction as well.

In order to enable this hydrodynamic pressure bearing 13 to demonstrate a fluid pumping action, the following characteristic means have been devised.

First hydrodynamic pressure Pd15 generated from the first hydrodynamic pressure generating groove 15 shown in FIGS. 2 and 3 is set so as to become smaller than second hydrodynamic pressure Pd16 generated from the second hydrodynamic pressure generating groove 16. More specifically, the first hydrodynamic pressure Pd15 on the side of the fluid flow inlet 11 is set so as to become positively smaller than the second hydrodynamic pressure Pd16 on the side of the fluid flow outlet 12.

As a result, the fluid can reliably be moved along the fluid pumping direction Z from the first hydrodynamic pressure of a small value (from the side in which static pressure is high) to the second hydrodynamic pressure of a large value (to the side in which static pressure is low).

In order to set the first hydrodynamic pressure Pd15 of the fluid flow inlet 11 so as to become reliably lower than the second hydrodynamic pressure Pd16 on the side of the fluid flow outlet 12, it is possible to use the following system or a combination of the following systems.

In order that the first hydrodynamic pressure Pd15 of the first hydrodynamic pressure generating groove 15 may reliably become smaller than the second hydrodynamic pressure Pd16 of the second hydrodynamic pressure generating groove 16, the pump 10 shown in FIG. 1 is devised as follows.

(1) As shown in FIG. 3, the width L15 of the first hydrodynamic pressure generating groove 15 along its axial direction shown in FIG. 3 is set to be narrower than the width L16 of the second hydrodynamic pressure generating groove 16 along its axial direction.

(2) As shown in FIG. 3, the fluid inlet angle θ15 of the first hydrodynamic pressure generating groove 15 is set to be larger than the fluid inlet angle θ16 of the second hydrodynamic pressure generating groove 16.

(3) Depths of the first and second hydrodynamic pressure generating grooves 15 and 16 are set to be different from each other.

In this case, while the depths of the first and second hydrodynamic pressure generating grooves are neither increased nor decreased indiscriminately, the depths of the first and second hydrodynamic pressure generating grooves should be set in consideration of a ratio between a clearance between the shaft 14 and the cylindrical member 13A of the hydrodynamic pressure bearing 13, and a relationship between the depths of the first and second hydrodynamic pressure generating groove is of a nonlinear type relationship with a peak value.

(4) The first portion 14A of which diameter decreases toward the fluid flow inlet 11 is provided on the shaft 14 with respect to the second portion 14B with the large diameter. As a result, since the clearance between the first portion 14A of the shaft 14 and the cylindrical member 13A increases overwhelmingly as compared with the clearance between the second portion 14B and the cylindrical member 13A, hydrodynamic pressure generated from the side of the first portion 14A decreases as compared with that from the second portion 14B.

The pump 10 according to the embodiment of the present invention has devised special shapes of the hydrodynamic pressure bearing 13 and the shaft 14. Accordingly, the fluid L shown in FIG. 1 can flow reliably along the pumping direction Z from the fluid flow inlet 11 to the fluid flow outlet 12. In addition, a thrust bearing 17 is provided on the side of the fluid flow outlet 12.

More specifically, the thrust bearing 17 plays the role of preventing the shaft 14 from moving from the side in which hydrodynamic pressure is low, that is, from the side of the first hydrodynamic pressure generating groove 15 to the side in which hydrodynamic pressure is high, that is, to the side of the second hydrodynamic pressure generating groove 16. Therefore, the pump 10 can be used in actual practice with high reliability.

To pump the above-mentioned fluid L in the fluid flow passage 130 along the pumping direction Z can freely be realized by one method or a combination of a plurality of methods. It is not so easy to pull out the coil 300 shown in FIG. 1 from the fluid flow passage 130 through which fluid passes to the outside. Unless a packing at the portion from which the coil 300 is led out from the fluid flow passage is perfect, then fluid will leak from the pump.

However, in the pump 10 shown in FIG. 1 according to the present invention, the coil 300 is located at the outside of the first diaphragm 102 and sealed into the outermost wall 103. Therefore, the lead wire 19L can be led out from the coil 300 to the outside through the outermost wall 103 easily with high reliability.

After the space forming member 19 has been provided on the first diaphragm 102, the outermost wall 103 is formed around the first diaphragm 102 and the space forming member 19. This outermost wall 103 is made of the high polymer material as described above. The outermost wall 103 has a seamless structure to cover the first diaphragm 102 and the space forming member 19. Accordingly, except the fluid flow inlet 11 and the fluid flow outlet 12, the rotating portion 121 can reliably be isolated from the outside, and hence there can be removed a disadvantage such as leakage of fluid.

The first diaphragm 102 is made of a metal such as a brass and a stainless steel or a high polymer material such as LCP, polyamide, polyimide, PC and POM. In this case, if a high polymer material in which temperature required when the outermost wall 103 is molded can fall within a temperature range in which the high polymer material forming the first diaphragm 102 can be used is available, then the first diaphragm 102 and the outermost wall 103 can be formed by a so-called two-step molding method.

It is needless to say that the space forming member 19 may be made of a metal such as a brass and a stainless steel or it may be made of the above-mentioned high polymer material.

Figure 4:
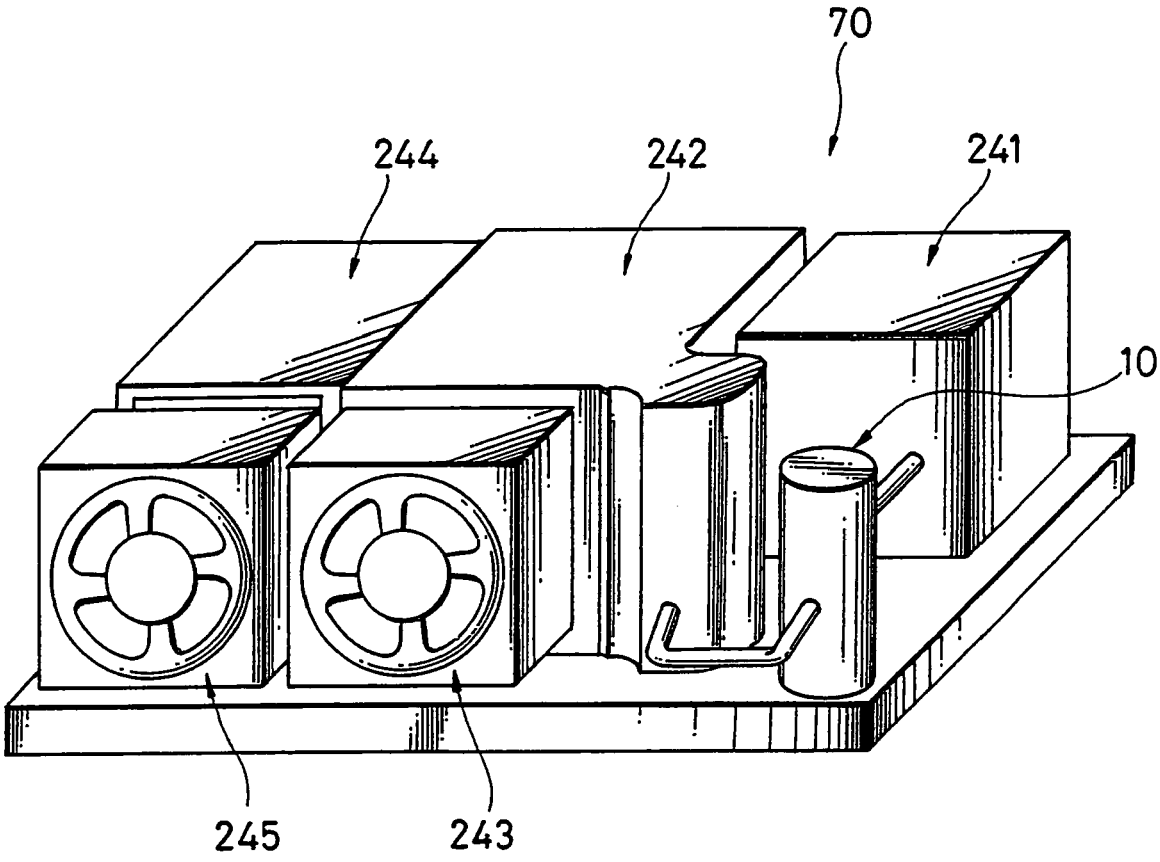
FIG. 4 is a perspective view showing an example of a fuel cell to which the pump according to the present invention is applied.
Figure 5:
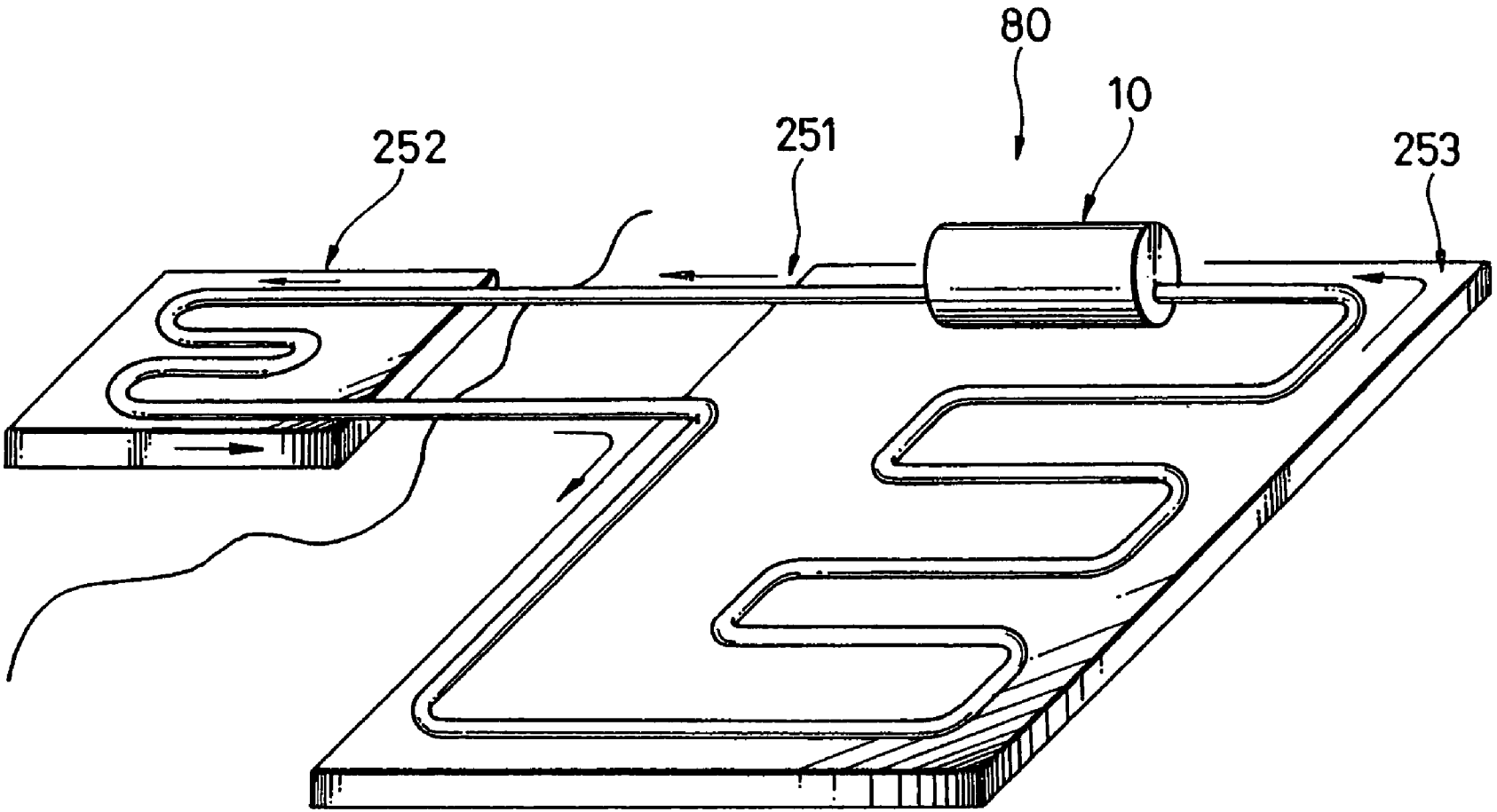
FIG. 5 is a perspective view showing an example of a CPU cooling device to which the pump according to the present invention is applied.
Figure 6:
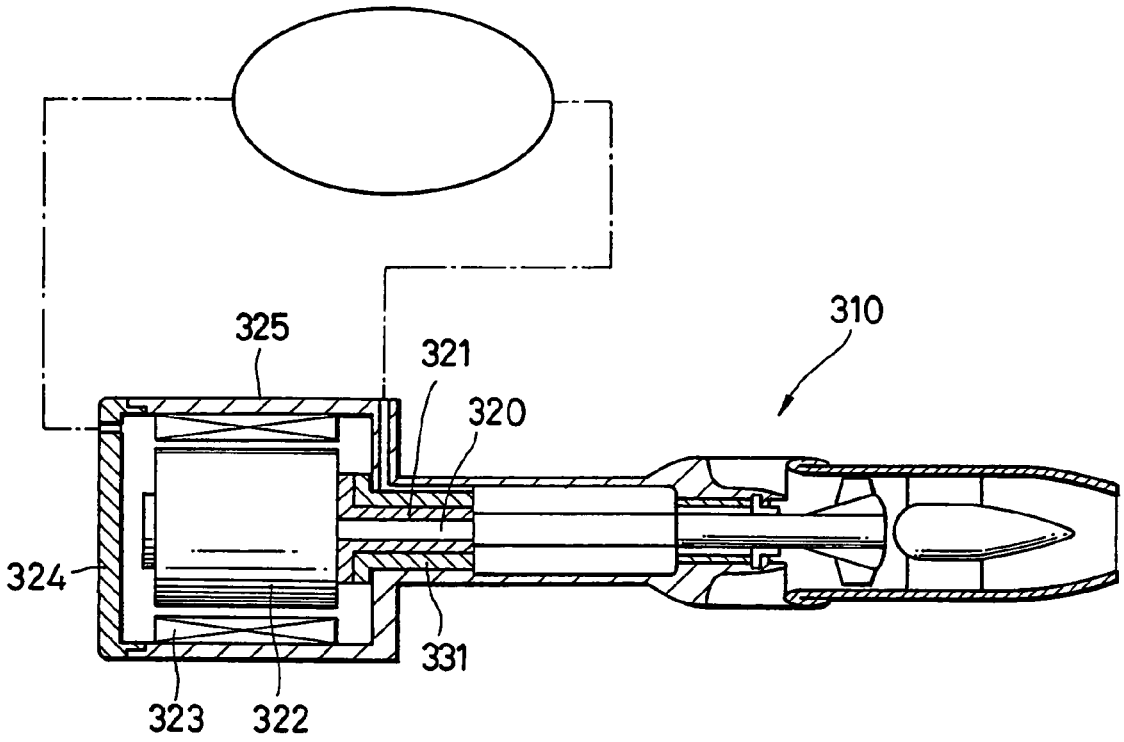
FIG. 6 is a diagram showing a cross-sectional structure of a pump according to the prior art.
Figure 7:
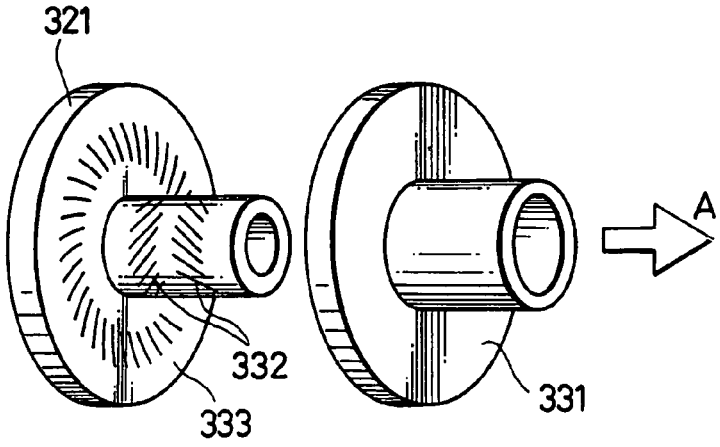
Prior Art FIG. 7
FIG. 7 is a perspective view showing a hydrodynamic pressure generating portion of the conventional pump shown in FIG. 6.

The pump 10 according to the present invention can be applied to a fuel cell 70 shown in FIG. 4 and a CPU (central processing unit) cooling apparatus 80 shown in FIG. 5.

The fuel cell 70 shown in FIG. 4 is provided with the pump 10 according to the present invention. The fuel cell 70 plays the role of a pump to pump liquid hydrogen fuel to the fuel cell system.

This fuel cell system uses the pump 10 to supply hydrogen from a hydrogen storage tank 241 into a reaction tank 242 and lets air flow into a fan motor 243 so that hydrogen may react with oxygen in air to generate electricity.

The above fuel cell system is provided with a control circuit for controlling a quantity of hydrogen and an electric circuit such as a sensor for controlling reaction heat and humidity. The reaction tank 242 is provided with a heat sink 244 to restrain temperature from rising due to reaction heat. Further, the heat sink 244 is cooled by air from a cooling fan motor 245, and hence cooling effect can be improved.

The fuel cell 70 is provided with the pump of the present invention, and hence it can be miniaturized. In other words, since the hydrogen storage tank can increase in size, it is possible to increase a reaction time.

When the fuel cell generates electricity, the amount of supplied hydrogen should be controlled while intensity of produced heat and humidity are being sensed. The rotary pump 10 according to the present invention is simple in control FIG. 5 shows the CPU cooling apparatus 80 to which the pump 10 according to the present invention is applied. Cooling liquid such as water is filled into this CPU cooling apparatus 80. The CPU cooling apparatus 80 is a circulating type cooling apparatus in which cooling liquid is passed through a route 252, a CPU 252, a cooling plate 253 and returned to the pump 10 when the pump 10 is driven.

For example, when the CPU cooling apparatus 80 is mounted on a notebook type personal computer, the notebook type personal computer becomes small in size and becomes excellent in cooling efficiency so that an electric current used up by the CPU 252 can decrease.

As described above, the pump 10 according to the present invention can employ a wide variety of materials such as water, liquid hydrogen fuel, antifreezing liquid and cooling oil as fluid.

When the pump of the present invention is used as a pump for a fuel cell, it is used to pump liquid hydrogen and methanol, and it is unavoidable that any liquid used therein can easily corrode a metal. Accordingly, it is desired that the surface of the member which is directly touched with liquid should be made of a high polymer material as much as possible.

According to the embodiment of the present invention, the hydrodynamic pressure bearing type pump includes the hydrodynamic pressure bearing with more than two hydrodynamic pressure generating grooves of the radial direction. This hydrodynamic pressure bearing plays the role of rotatably supporting the shaft with respect to the radial direction and also plays the role of generating pumping pressure for pumping liquid as well. Therefore, the hydrodynamic pressure bearing type pump can be miniaturized.

Since various shapes have so far been devised for the shapes of the hydrodynamic pressure bearing, it is possible to move the fluid to one direction along the pumping direction Z with reliability. Since the shaft 14 is supported by the thrust bearing so that it can freely rotate in the thrust direction, the hydrodynamic pressure bearing type according to the present invention is highly useful in practical use.

The rotor magnet disposed in the fluid has the high polymer material formed thereon by an outsert molding method or a coating method. In addition, the coil is disposed outside the first diaphragm. Accordingly, since both of the rotor magnet and the coil can be prevented from being directly touched with the liquid, the rotor magnet and the coil are difficult to corrode, and the wiring from the coil need not be led out from the inside of the pump to the outside.

The circumference of the pump is sealed by the outermost wall seamlessly, and hence it is possible to provide the highly-reliable hydrodynamic pressure bearing type pump in which fluid can be prevented from being leaked.

As set forth above, according to the present invention, the shaft rotates to generate hydrodynamic pressure to thereby rotatably support the shaft in the radial direction. At the same time, the hydrodynamic pressure bearing can generate fluid pumping pressure with reliability, and it can be miniaturized.

The present invention is not limited to the above-described embodiment.

It is needless to say that the hydrodynamic pressure bearing type pump according to the present invention is not only used to pump fluid in the above-mentioned CPU cooling apparatus and the fuel cell but also it is suitable for use with other kinds of apparatus.

The first and second hydrodynamic pressure generating grooves are formed on the inner peripheral surface of the cylindrical member in the above-mentioned embodiment. However, the present invention is not limited to the above-mentioned embodiment, and it is needless to say that the first and second hydrodynamic pressure generating grooves may be formed on the outer peripheral surface of the shaft.

The invention claimed is:

1. In a hydrodynamic pressure bearing type pump in which a shaft rotates to generate hydrodynamic pressure to let fluid flow, a hydrodynamic pressure bearing type pump comprising:

a main body including an outer housing and an inner housing surrounded by the outer housing, the outer housing having a fluid flow inlet formed at one end portion thereof and a fluid flow outlet formed at the other end portion thereof; and a rotating portion disposed within a fluid flow passage of said fluid within said inner housing of said main body to generate hydrodynamic pressure to let said fluid flow into said fluid flow inlet and through said inner housing and to let said fluid flow from said inner housing and through said fluid flow outlet to the outside, said rotating portion comprising:

a shaft extending along an axis of rotation and having a first shaft end and an opposite second shaft end, the shaft having a first shaft piece and a second shaft piece integrally connected to each other along the axis of rotation, the first shaft piece having a first shaft piece diameter and a second shaft piece having a second shaft piece diameter being larger than the first shaft piece diameter;

a hydrodynamic pressure bearing connected to the first shaft end and operative for generating hydrodynamic pressure to let said fluid flow into said fluid flow inlet and through said inner housing and to let said fluid flow from said inner housing and through said fluid flow outlet to the outside when said shaft is rotated; and a rotation force generating portion disposed within said main body to generate rotation force for rotating said shaft when it is energized, the rotation force generating portion including a rotor magnet connected to the second shaft end and a coil embedded into the outer housing and surrounding the rotor magnet and a portion of the inner housing, said hydrodynamic pressure bearing including:

a hydrodynamic pressure bearing body member having an inner cylindrical surface defining a shaft-receiving hole formed axially therethrough, the shaft-receiving hole sized to slidably and rotatably receive the shaft, the inner cylindrical surface having a first hydrodynamic pressure generating groove formed at the position near the side of said fluid flow inlet; and a second hydrodynamic pressure generating groove formed at the position near the side of said fluid flow outlet, wherein the first shaft piece and the second shaft piece are rotatably received in the shaft-receiving hole such that, as viewed along the axis of rotation, at least a portion of first hydrodynamic pressure generating groove surrounds the first shaft piece and the second hydrodynamic pressure generating groove in its entirety surrounds the second shaft piece.

2. A hydrodynamic pressure bearing type pump according to claim 1, wherein said shaft has an end portion supported to a thrust bearing within said main body such that said end portion can rotate in the thrust direction.

3. A hydrodynamic pressure bearing type pump according to claim 2, wherein said first hydrodynamic pressure generating groove is small in width with respect to the axial direction of said shaft as compared with a width of said second hydrodynamic pressure generating groove with respect to the axial direction of said shaft.

4. A hydrodynamic pressure bearing type pump according to claim 2, wherein said first hydrodynamic pressure generating groove has a depth smaller than that of said second hydrodynamic pressure generating groove.

5. A hydrodynamic pressure bearing type pump according to claim 2, wherein said first and second hydrodynamic pressure generating grooves are herring-bone grooves and said first hydrodynamic pressure generating groove has a large fluid inlet angle as compared with that of said second hydrodynamic pressure generating groove.

6. A hydrodynamic pressure bearing type pump according to claim 1, wherein said hydrodynamic pressure bearing has a cylindrical portion made of a sintered metal and said fluid is lubricating oil.

7. A hydrodynamic pressure bearing type pump according to claim 1, wherein said main body serves for sealing said rotating portion disposed in said main body.

8. A hydrodynamic pressure bearing type pump according to claim 1, wherein said main body has a diaphragm disposed therein, said rotation force generating portion includes an armature coil and a magnet for rotating said shaft when said armature coil is energized, said armature coil is located at the outside of said diaphragm within said main body and said magnet is fixed to the outer peripheral surface of said shaft.

9. A hydrodynamic pressure bearing type pump according to claim 8, wherein said magnet has a coating member disposed on a surface thereof to cover said magnet from said fluid.

10. A hydrodynamic pressure bearing type pump according to claim 8, wherein said main body serves as another diaphragm for covering the circumference of said diaphragm.

11. A hydrodynamic pressure bearing type pump adapted to pump a fluid therethrough, comprising:

a main body extending along a longitudinal axis and including a longitudinally-extending outer housing and a longitudinally-extending inner housing surrounded by and in contact with the outer housing, the outer housing having a longitudinally-extending fluid flow inlet formed at one end portion thereof and a longitudinally-extending fluid flow outlet formed at the other end portion thereof, the inner housing having longitudinally-extending fluid flow passage in fluid communication with and between the fluid flow inlet and the fluid flow outlet;

a shaft extending along an axis of rotation and having a first shaft end and an opposite second shaft end, the shaft having a first shaft piece and a second shaft piece integrally connected to each other along the axis of rotation, the first shaft piece having a first shaft piece diameter and a second shaft piece having a second shaft piece diameter being larger than the first shaft piece diameter;

a hydrodynamic pressure bearing having a hydrodynamic pressure bearing body member having an inner cylindrical surface defining a shaft-receiving hole formed axially therethrough, the shaft-receiving hole sized to slidably and rotatably receive the shaft, the inner cylindrical surface having a first hydrodynamic pressure generating groove formed at the position near the side of said fluid flow inlet and a second hydrodynamic pressure generating groove formed at the position near the side of said fluid flow outlet, the hydrodynamic pressure bearing connected to the first shaft end;

a rotor magnet assembly connected to the second shaft end; and a coil embedded in the outer housing and surrounding the rotor magnet and a portion of the inner housing in a manner to isolate the coil from fluid communication with the fluid flow passage, wherein the first shaft piece and the second shaft piece are received in the shaft-receiving hole such that, as viewed along the axis of rotation, at least a portion of first hydrodynamic pressure generating groove surrounds the first shaft piece and the second hydrodynamic pressure generating groove in its entirety surrounds the second shaft piece and wherein, upon energizing the coil, the shaft, the hydrodynamic pressure bearing and the rotor magnet assembly rotate within the fluid flow passage of the inner housing to generate hydrodynamic pressure sufficient to pump the fluid from the fluid flow inlet, through the fluid flow passage and out of the fluid flow outlet.

12. A hydrodynamic pressure bearing type pump according to claim 11, further comprising a hemispherical surface end portion connected to the hydrodynamic pressure bearing opposite to the first shaft end.

13. A hydrodynamic pressure bearing type pump according to claim 12, wherein the inner housing includes a hemispherical surface end support portion extending radially relative to the longitudinal axis, the hemispherical surface end support portion contacting the hemispherical surface end portion when the shaft, the hydrodynamic pressure bearing and the rotor magnet assembly rotate within the fluid flow passage of the inner housing.

14. A hydrodynamic pressure bearing type pump according to claim 1, wherein first hydrodynamic pressure generated from said first hydrodynamic pressure generating groove with respect to the radial direction is smaller than second hydrodynamic pressure generated from said second hydrodynamic pressure generating groove with respect to the radial direction when said shaft is rotated.

* * * * *